US005783060A

United States Patent [19]

La Riviere et al.

[11] Patent Number: 5,783,060

[45] Date of Patent: Jul. 21, 1998

[54] ELECTROLYTIC METAL RECOVERY METHOD

[75] Inventors: John La Riviere, Beaconsfield; Bernard Gravel; Gordon Bathurst, both of Pointe Claire, all of Canada

[73] Assignee: Metafix Inc., Lachine, Canada

[21] Appl. No.: 760,305

[22] Filed: Dec. 4, 1996

[51] Int. Cl.[6] ..... C25B 15/02

[52] U.S. Cl. ..... 205/337; 205/507; 205/702; 205/771

[58] Field of Search ..... 205/337, 507, 205/702, 771; 204/229

[56] References Cited

U.S. PATENT DOCUMENTS

| | | | |
|---|---|---|---|
| 4,675,085 | 6/1987 | Vasquez | 204/229 |
| 4,776,931 | 10/1988 | Hardy | 204/105 R |
| 5,102,513 | 4/1992 | Pelkus | 205/337 |
| 5,310,466 | 5/1994 | La Rivière et al. | 204/228 |

FOREIGN PATENT DOCUMENTS

| | | |
|---|---|---|
| 1 188 822 | 3/1965 | Germany . |
| 39 22 959 | 12/1989 | Germany . |

OTHER PUBLICATIONS

Derwent Abstract of Soviet Patent 1 258 888, Sep. 23, 1986.

*Primary Examiner*—Bruce F. Bell

*Attorney, Agent, or Firm*—Wolf, Greenfield & Sacks, P.C.

[57] ABSTRACT

The cell controller 18 responds to a number of specific conditions including a flow switch 24 output signal 34 which indicates that fresh solution flows from a reservoir 14 into the metal solution tank 12. The cell will be caused to operate in the plating mode in response to the detection of fresh solution flow, and cell performance can be monitored by comparing an estimate of metal released into the solution based on flow of fresh solution and a measurement of metal recovered. The invention is particularly advantageous for controlling the electrolytic recovery of silver from photographic processing solution.

9 Claims, 2 Drawing Sheets

ELECTROLYTIC METAL RECOVERY METHOD

BACKGROUND OF THE INVENTION (a). Field of the Invention

The present invention relates to methods for controlling the recovery of metal from an electrolytic solution in an electrolytic cell of a type which operates either in a standby mode or in a plating mode. More specifically, the present invention relates to improved methods for controlling such electrolytic metal recovery.

(b). Description of Prior Art

It is known in the art to recover metal from an electrolytic solution in an electrolytic cell operating either in a standby mode having associated with it a standby current level, or a plating mode having associated with it a plating current level, such as in U.S. Pat. No. 5,310,466 granted May 10, 1994 to La Riviere et al. One specific application for such an electrolytic metal recovery system is in the recovery of silver from photographic developing process solution. In such systems, it has been found desirable to remove silver ions from the solution in order to improve the efficiency of the solution. However, such solution can be damaged by subjecting it to large electrolysis voltages which would normally be used to remove silver ions from the solution under circumstances when the concentration of silver ions in solution is inadequate to result in the current being passed through the electrolytic cell.

Since the concentration of silver ions in the photographic solution increases whenever film is developed (namely at sporadic intervals), it has been found useful in the prior art to operate the electrolytic cell either in a standby mode having associated with it a very low standby current level which cannot damage the photographic solution, or in a plating mode having associated with it a sufficient plating current level to remove silver ions sufficiently rapidly from the photographic solution. In the prior art method, the electrolytic cell would switch from plating mode operation to standby mode operation when the current level would drop below an OFF point threshold when operating at a voltage at which the cell had previously operated at the plating current level. Similarly, the electrolytic cell would begin to operate in plating mode when the current level in the standby mode went above a predetermined ON current level with the voltage in the electrolytic cell being at a voltage which had previously provided a standby current level. When entering the standby mode or the plating mode, the voltage in the electrolytic cell was allowed to vary in order to provide a stable and constant associated current level for the appropriate mode. The calibration or stabilization period could be about 2 minutes.

It has been found that the prior art control system and method provide electrolytic cell operation which responds well under basic operating conditions. However, the operating conditions are often variable and unpredictable and the ability of the system to respond promptly, accurately and reliably to a variety of operating conditions is not perfect.

SUMMARY OF THE INVENTION

Accordingly, it is an object of the present invention to provide methods for recovering metal from an electrolytic solution in an electrolytic cell operating either in a standby mode or a plating mode which are more responsive to the operating conditions with a result that performance is improved. Improved performance results from maintaining the operating voltage as optimally low as possible, switching from the standby mode to the plating mode as quickly possible when required, or increasing the rate of recovery of the electrolytic metal.

According to a first aspect of the present invention there is provided an electrolytic metal recovery method for recovering metal from an electrolytic solution in an electrolytic cell operating either in a standby mode having associated with it a standby current level, or a plating mode having associated with it a plating current level, the method comprising the steps of: measuring a concentration of the metal in the solution; comparing the concentration to a predetermined recorded acceptable level; adjusting as a function of a result of the comparing, if need be, an initial gain current level of the plating current level to increase or decrease a rate of plating; adjusting an OFF level as a function of any adjustment of the initial gain current level; adjusting voltage in the cell at a beginning of the plating mode such that the plating current level reaches the gain level; switching from the plating mode to the standby mode when the plating current level drops below the OFF level, whereby the rate of plating is controlled by setting the gain level as a result of the metal concentration measurement.

The first aspect of the present invention allows the sensitivity and performance of the electrolytic metal recovery to be improved by making an adjustment in the field. This adjustment of performance can be done by the operator in the field at regular intervals and permits the electrolytic metal recovery process to be tuned for the specific requirements of the solution being processed.

Accordingly to a second aspect of the present invention, there is provided an electrolytic metal recovery method for recovering metal from an electrolytic solution in an electrolytic cell operating either in a standby mode having associated with it a standby current level, or a plating mode having associated with it a plating current level, the method comprising the steps of: circulating the electrolytic solution with solution in a processing tank; monitoring flow of new solution into the tank using flow detecting means; determining based on an amount of the flow monitored whether a sufficient concentration of the metal should be present in the tank solution for efficient plating; and causing the cell to operate in the plating mode when it is determined in the previous step that sufficient concentration of the metal should be present in the tank solution for efficient plating.

It has been found that the use of flow detecting means provides a simple, reliable and robust way to determine that new solution is being fed into the tank. Use of the flow detecting means, such as a reed valve flow switch, to determine whether the cell should operate in plating mode is preferably used as a reliable backup to detecting the current level rise above an ON threshold while the cell is operating in the standby mode.

According to an third aspect of the present invention, there is provided an electrolytic metal recovery method for recovering metal from an electrolytic solution in an electrolytic cell operating either in a standby mode having associated with it a standby current level, or a plating mode having associated with it a plating current level, the method comprising the following steps: monitoring flow of new solution into the tank using flow detecting means over a period of time; deriving an estimate of electrolytic metal released into the solution over the period of time based on the monitoring; harvesting and measuring an amount of recovered metal from the cell at an end of the time period; and comparing the estimate of electrolytic metal released into the solution with the amount of recovered metal to determine an efficiency of operation of the cell.

It has been found that it is desirable to have some evidence that the recovery system is functioning as it should. In the specific case of silver recovery from photographic processing solution, the flow detecting means is a rough estimate of the amount of film processed, and thus a rough estimate of the amount of silver released into the solution. By monitoring and recording the flow detector's activity to obtain a film count estimate, a comparison of this estimate with the amount of sliver harvested from the cell will confirm proper operation.

BRIEF DESCRIPTION OF THE DRAWINGS

The invention will be better understand by way of the following detailed description of a preferred embodiment with reference to the appended drawings in which.

DETAILED DESCRIPTION OF THE PREFERRED EMBODIMENT

Figure 1:
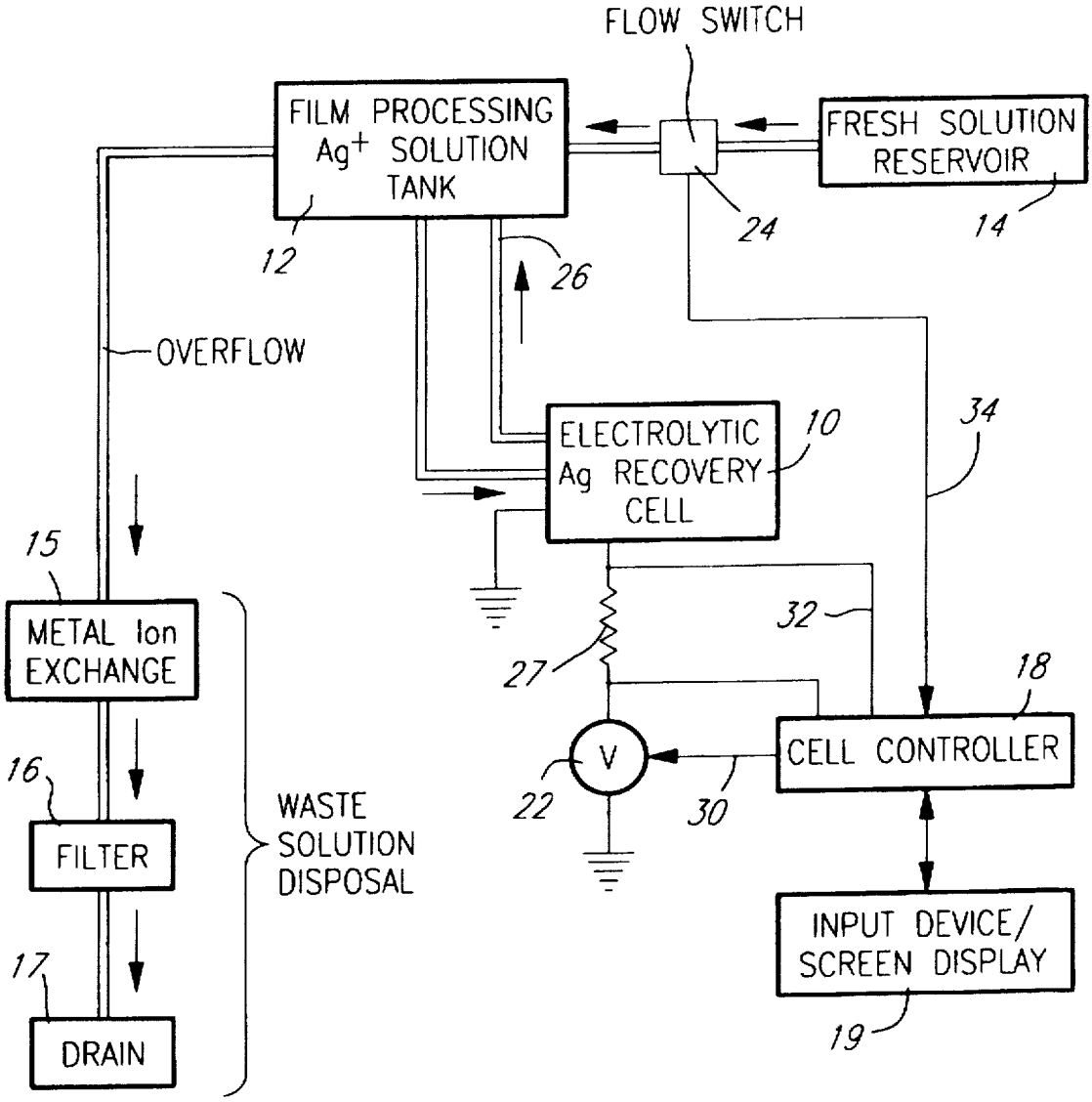
FIG. 1 is a schematic block diagram of the metal recovery system according to the preferred embodiment.

Shown in FIG. 1 is a system diagram of a photographic film processing system including a film processing solution tank 12. As film is developed, silver ions are released into the solution and are to be recovered in the electrolytic silver recovery cell 10. As the film processing solution loses its concentration of chemicals which are consumed during processing, fresh solution is pumped in from a fresh solution reservoir 14. In accordance with the invention, a flow switch 24 is inserted into the line communicating the reservoir 14 with the tank 12. As fresh solution is brought in, the overflow is passed through to a metal ion exchange system 15 which removes any residual silver ion in the solution in an ion exchange process with iron. The resulting liquid is filtered in filter 16 before being passed on to the drain 17.

In the electrolytic silver recovery cell 10, a voltage is applied across a cathode and an anode from a voltage source 22. A cell controller 18 includes a microcontroller which controls the operation of the voltage source for carrying out the electrolytic metal recovery. The cell 10 is in circulatory fluid communication with tank 12 via a pair of circulation lines 26 and circulation pumps (not shown). The cell controller 18 sets the variable voltage source 22 on line 30 and keeps track of the exact voltage and current in the cell. Shown in FIG. 1 is a resistor 27 in series with the voltage applied to cell 10 from which a current measurement can be obtained by line 32. A screen and keypad 19 is also provided for programming the controller 18 and displaying operational parameters and program settings to the user. The flow switch 24 sends the electrical signal on line 34 to the cell controller 18 whenever solution is being pumped from reservoir 14 into tank 12.

In the typical operation of the system, the cell controller operates either in plating mode or in standby mode. The plating mode typically operates in the voltage range of 0.7 to 1.2 volts in the preferred embodiment. The system begins by attempting to reach a plating current level. The target plating current level is referred to as the gain point. The controller 18 sets the voltage in the cell to a level not exceeding a maximum permissible voltage such as 1.3 volts until the current measured is the gain level. The gain level may be for example 2 amps. During a calibration period, the voltage is varied to maintain the current at the gain point until it seems that the voltage has stabilized. The voltage is then locked at the voltage level which is yielding the gain point current level. Plating is allowed to continue with the voltage locked with the result that reduction in the concentration of silver ions in the cell will produce a drop in conductivity and in cell current. When the cell current drops below an OFF point or an OFF current level, such as for example 1.3 amps, it is presumed that enough silver ions have been removed from the solution and it could be harmful to the solution to continue subjecting it to the electrolytic voltage. The system then switches to the standby mode.

In the standby mode, the voltage is lowered to about 0.5 volts which yields a current of about 50 milliamps. The standby voltage is adjusted by controller 18 to maintain the standby current level of 50 milliamps during a calibration period of a few minutes at the end of which the standby voltage is locked and allowed to vary. When the standby voltage generates a current which goes above an ON current level of about 55 milliamps, it is presumed that there has been an increase in the conductivity of the solution in the cell 10 indicating that electrolytic silver recovery should recommence. At this point, the controller 18 recalibrates the cell to be in plating mode.

Figure 2:
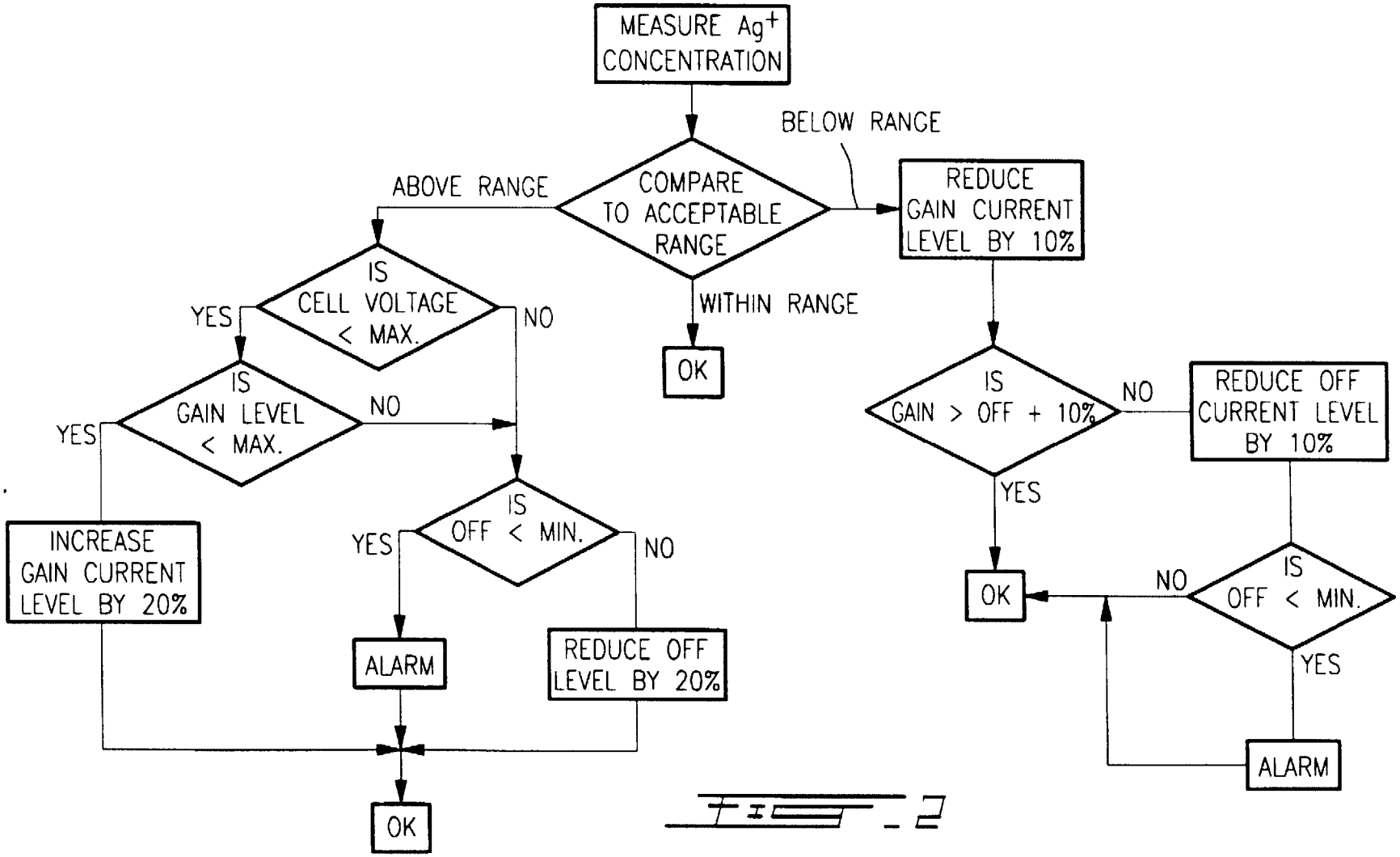
FIG. 2 is a flow diagram illustrating the process according to the first aspect of the invention in the preferred embodiment.

According to the first aspect of the present invention, the initial gain current level is adjusted based on an input using device 19. As illustrated in FIG. 2, the user inputs a measured silver ion concentration using input device 19. The controller 18 compares the measured ion concentration level to an acceptable range. The acceptable range would indicate that the electrolytic metal recovery process is operating efficiently. If the measured concentration is lower than the acceptable range, then the electrolytic cell is overplating and therefore the gain current level is reduced by 10%. If this reduction of the gain current level forces the gain current to be to close to the OFF level by a margin of 10%, then the OFF current level is also reduced by 10%. If the OFF level is thereby reduced to a level which is below an acceptable minimum, then an alarm warning message is generated.

In the preferred embodiment, the silver ion concentration is measured using a silver ion concentration test strip which is physically dipped into the electrolytic solution in the cell. This provides a visual indication of the approximate silver ion concentration in the solution. The electrolysis process is thus adjusted to operate within a more efficient range. If the testing frequency were great enough, it is possible to adjust the levels by a fixed small percentage or amount. In the preferred embodiment, weekly testing and adjustment is typically more than sufficient.

If the measured silver ion concentration is above the acceptable range, then the cell is not operating in the plating mode efficiently enough. In this condition, it is first determined whether the cell voltage in the plating mode may be further raised or whether the cell voltage is below a maximum acceptable cell voltage. If the cell voltage is near or above the maximum acceptable voltage then it is checked to see whether the OFF level can be lowered with the result that the plating time would be increased. If the OFF level is already at or below an acceptable minimum value for the OFF level then an alarm message is generated. In the latter condition, the cell would be likely malfunctioning perhaps due to an electrical disconnection.

If the OFF level is not below the acceptable minimum, then the OFF level may be reduced. In the preferred embodiment the amount of reduction is one of three fixed amounts, namely by 10% if the measured silver ion concentration is about 1 g/L, by 20% if the measured silver ion concentration is about 3 g/L (this is the case in FIG. 2), and by 30% if the measured silver ion concentration is about 5 g/L. If the cell voltage can be increased then it is checked whether the gain current level is already at or above the maximum acceptable gain current level. If not, then the compensation in response to the measured silver ion concentration being too high is achieved by increasing the initial gain current level by the same percentage as is chosen for the OFF current level.

As can be appreciated, it would also be possible to adjust the initial gain current level as a linear function of the difference between the measured metal ion concentration and the target concentration value instead of the stepwise function of the preferred embodiment. In the preferred embodiment, however, the stepwise adjustment has been found satisfactory and is commensurate with the accuracy of the operator's measurement of the silver ion concentration. In the preferred embodiment, the silver ion concentration is measured using a silver ion concentration test strip which is physically dipped into the electrolytic solution in the cell. This provides a visual indication of the approximate silver ion concentration in the solution. The electrolysis process is thus adjusted to operate within a more efficient range. If the testing frequency were great enough, it is possible to adjust the levels by a fixed small percentage or amount. In the preferred embodiment, weekly testing and adjustment is typically more than sufficient.

According to the second aspect of the invention, the signal on line 34 coming from the flow switch as illustrated in FIG. 1 is used in two different ways. Firstly, the controller 18 may cause the cell to operate in the plating mode if it is in the standby mode after detecting that a certain amount of fresh solution has been pumped into the tank 12. In the system illustrated in FIG. 1, fresh solution from reservoir 14 is pumped into tank 12 as a function of film processing by the film processing system which uses tank 12. Therefore, the draw of fresh solution from reservoir 14 is indicative of an increase in the silver ion concentration in tank 12. Therefore, even if the cell controller 18 had not sensed a sufficient rise in the cell current level above the ON point to cause the controller 18 to operate the cell in the plating mode, if the monitoring of the flow switch signal indicates that the cell should be operating in plating mode, then the controller 18 will automatically switch to the plating mode. And secondly, if the cell was operating in the calibration phase of the plating mode to determine the voltage which will give the initial gain current level, the controller 18 will extend the calibration period upon receipt of additional flow switch signals since it is expected that the nature of the solution in the tank 12 and in cell 10 may be in flux.

According to the invention, the detection of new solution drawn in to tank 12 from the reservoir 14 may also be used to control a maximum duration of the active plating mode. In the preferred embodiment, controller 18 locks the cell in the plating mode for a predetermined user selected maximum duration (e.g. 1 h, 3 h, or 5 h) after the last film has passed, as is detected by monitoring the flow switch 24. This ensures that the cell stops plating when it is expected that plating should be completed, even if the off current level has not been reached.

According to the third aspect of the invention, the flow of new solution into the tank as detected using the flow detecting means, namely flow switch 24 is monitored over a period of time such as a day. The time period may be more or less and depends on the need to harvest. An estimate of the amount of electrolytic metal released into the solution over the time period is derived based on the monitoring. This requires some initial calibration. The flow switch generates signal when the replenishing pump is activated in the film processor. The film processor activates the replenishing pump for a set time period every time a precalibrated amount of film is passed through the processor. The initial calibration involves passing film through the processor and observing the flow switch activity to obtain a correlation between the two, so that future flow switch activity can be used to obtain a film count measurement. The amount of silver released into solution is roughly proportional to the film count, although this depends on exposure.

At the end of the time period, the cell is harvested and the amount of recovered metal from the cell at an end of the time period is measured. By comparing the estimate of electrolytic metal released into the solution with the amount of recovered metal, an estimate of the efficiency of operation of the cell can be determined. In the preferred embodiment, cell activity is also recorded by controller 18 for the purposes of generating an operation report. Whether the cell is operating in the standby mode or the plating mode is recorded over the time period, along with the initial gain current levels, OFF current levels, gain voltage levels and standby voltage levels. The operation report contains the times of operation in the standby mode and the plating mode as well as the film counts. The report allows service personnel to understand how the cell operated. The report also gives a confirmation that the cell was operating normally and performing correctly.

We claim:

1. An electrolytic metal recovery method for recovering metal from an electrolytic solution in an electrolytic cell operating either in a standby mode having associated with it a standby current level, or a plating mode having associated with it a plating current level, said method comprising the steps of:

measuring a concentration of said metal in said solution;

comparing said concentration to a predetermined recorded acceptable level;

adjusting as a function of a result of said comparing, if need be, an initial gain current level of said plating current level to increase or decrease a rate of plating;

adjusting an OFF level as a function of any adjustment of said initial gain current level;

adjusting voltage in said cell at a beginning of said plating mode such that said plating current level reaches said gain level;

switching from said plating mode to said standby mode when said plating current level drops below said OFF level, whereby said rate of plating is controlled by setting the gain level as a result of the metal concentration measurement.

2. The method as claimed in claim 1, wherein a voltage required to reach a desired initial gain current level is above a maximum desirable voltage level for said cell, and instead of increasing said gain level, said OFF level is lowered, whereby a duration of said plating mode will be increased with the likely result of lowering the metal concentration in said solution.

3. The electrolytic metal recovery method claimed in claim 1, wherein said metal is silver and said electrolytic solution is a silver ion solution.

4. An electrolytic metal recovery method for recovering metal from an electrolytic solution in an electrolytic cell operating either in a standby mode having associated with it a standby current level, or a plating mode having associated with it a plating current level, said method comprising the steps of:

circulating said electrolytic solution with solution in a processing tank;

monitoring flow of new solution into said tank using flow detecting means;

determining based on an amount of said flow monitored whether a sufficient concentration of said metal should be present in said tank solution for efficient plating; and causing said cell to operate in said plating mode when it is determined in the previous step that sufficient concentration of said metal should be present in said tank solution for efficient plating.

5. The method as claimed in claim 4, further comprising steps of:

timing a period of time since said new solution has flowed into said tank; and causing said cell to operate in said standby mode when said period of time exceeds a predetermined amount, whereby operating in said plating mode is limited to a predetermined maximum time period.

6. The electrolytic metal recovery method claimed in claim 4, wherein said metal is silver and said electrolytic solution is a silver ion solution.

7. An electrolytic metal recovery method for recovering metal from an electrolytic solution in an electrolytic cell operating either in a standby mode having associated with it a standby current level, or a plating mode having associated with it a plating current level, said method comprising the steps of:

monitoring flow of new solution into said tank using flow detecting means over a period of time;

deriving an estimate of electrolytic metal released into said solution over said period of time based on said monitoring;

harvesting and measuring an amount of recovered metal from said cell at an end of said time period; and comparing said estimate with said amount to determine an efficiency of operation of said cell.

8. The method as claimed in claim 7, further comprising steps of:

recording over said time period whether said cell is operating in said standby mode or said plating mode; and generating an operation report containing times of operation in said standby mode and said plating mode as well as information on said flow value switch activity.

9. The method as claimed in claim 7, wherein said solution is photographic processing solution, and said step of deriving includes deriving a film count measurement.

* * * * *